US012385173B2

(12) United States Patent
Lonati et al.

(10) Patent No.: US 12,385,173 B2
(45) Date of Patent: Aug. 12, 2025

(54) REMOVAL DEVICE FOR REMOVING A TUBULAR KNITTED MANUFACTURE FROM A CIRCULAR KNITTING MACHINE FOR HOSIERY OR THE LIKE

(71) Applicant: Lonati S.P.A, Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 17/632,715

(22) PCT Filed: Dec. 4, 2020

(86) PCT No.: PCT/EP2020/084638

§ 371 (c)(1),
(2) Date: Feb. 3, 2022

(87) PCT Pub. No.: WO2021/115953

PCT Pub. Date: Jun. 17, 2021

(65) Prior Publication Data

US 2022/0307167 A1 Sep. 29, 2022

(30) Foreign Application Priority Data

Dec. 11, 2019 (IT) ..... 102019000023577

(51) Int. Cl.
*D04B 9/40* (2006.01)
*D04B 1/26* (2006.01)
*D04B 15/02* (2006.01)

(52) U.S. Cl.
CPC ..... *D04B 9/40* (2013.01); *D04B 1/26* (2013.01); *D04B 15/02* (2013.01)

(58) Field of Classification Search
CPC ..... D04B 9/40; D04B 15/02
See application file for complete search history.

(56) References Cited

U.S. PATENT DOCUMENTS 4,608,839 A 9/1986 Tibbals, Jr.
6,164,091 A 12/2000 Frullini et al.
(Continued)

FOREIGN PATENT DOCUMENTS

CN 108291340 A 7/2018
CN 109477261 A 3/2019
(Continued)

OTHER PUBLICATIONS

Examination Report for Pakistan Application No. 843/2020 issued Sep. 15, 2021.
(Continued)

*Primary Examiner* — Megan E Lynch
(74) *Attorney, Agent, or Firm* — Quicker Law, LLC

(57) ABSTRACT

A removal device for removing a tubular knitted manufacture from a circular knitting machine for hosiery or the like, comprising an annular removal body which supports a plurality of removal members arranged around the axis of the removal body, which is arrangeable coaxially around the needle cylinder of a circular knitting machine; the removal members are supported by first and second annular portions, which can move by rotation with respect to each other about an oscillation axis in order to pass between a removal condition and a sewing condition, in which the annular portions are arranged so as to face each other, the removal members forming a respective removal head which can move on command along a removal trajectory which has a component that is parallel to the axis of the removal body and at least one radial component away from the axis.

4 Claims, 13 Drawing Sheets

(56) References Cited

U.S. PATENT DOCUMENTS

| | | | | |
|---|---|---|---|---|
| 2001/0039816 | A1* | 11/2001 | Fujiwara | D04B 15/06 66/13 |
| 2003/0074929 | A1 | 4/2003 | Jurgens | |
| 2006/0144095 | A1* | 7/2006 | Frullini | D04B 9/40 66/8 |
| 2010/0199723 | A1* | 8/2010 | Conti | D04B 9/40 66/13 |
| 2016/0024695 | A1* | 1/2016 | Conti | D04B 9/40 66/58 |
| 2017/0241052 | A1* | 8/2017 | Conti | D04B 15/02 |
| 2022/0034007 | A1 | 2/2022 | Lonati et al. | |

FOREIGN PATENT DOCUMENTS

| | | | | |
|---|---|---|---|---|
| EP | 0592376 | A1 | 4/1994 | |
| EP | 0942086 | A2 | 9/1999 | |
| EP | 2984220 | A1 | 2/2016 | |
| IT | MI20010586 | A1 | 9/2002 | |
| RU | 2176295 | C2 * | 11/2001 | D04B 11/24 |
| WO | 01/34890 | A1 | 5/2001 | |

OTHER PUBLICATIONS

Search Report for Italian Application No. 201900023577 issued Oct. 9, 2020.
Office Action re Chinese Application No. CN 202080057011.7, dated Feb. 7, 2023.
Office Action re Eurasia Application No. EAPO 202290234, dated Nov. 17, 2022.
Office Action mailed Jan. 24, 2024 in Colombian Application No. NC2022/0000359 with English-language translation (20 pgs.).
Office Action mailed Nov. 30, 2023 in Egyptian Application No. 2022020225 with English-language translation (20 pgs.).
Office Action mailed Mar. 31, 2024 in Korean Application No. 10-2022-7005396 with English-language translation (14) pgs.).
International Search Report and Written Opinion dated Feb. 17, 2021 in PCT/EP2020/084638 (13 pgs.).
Office Action mailed Jun. 11, 2024 in Japanese Application No. 2022-507545 with English-language translation (9 pgs.).
English-language Translation of Office Action mailed Jul. 16, 2024 in Egyptian Application No. 2022020225 (5 pgs.).
Office Action mailed Nov. 27, 2024 in Paraguay Application No. 2083509 with English-language translation (12 pgs.).

* cited by examiner

REMOVAL DEVICE FOR REMOVING A TUBULAR KNITTED MANUFACTURE FROM A CIRCULAR KNITTING MACHINE FOR HOSIERY OR THE LIKE

The present invention relates to a removal device for removing a tubular knitted manufacture from a circular knitting machine for hosiery or the like.

In the field of the production of tubular knitted manufactures with circular knitting machines for hosiery or the like, in some cases there is the need to perform a transfer of the manufacture from the machine used for the production of the manufacture to another production unit in order to perform further work on the manufacture that cannot be performed on said machine or that it is not economically convenient to perform on said machine.

In particular, in the field of the production of hosiery items, in recent years techniques for automatically closing their toe, by sewing or looping, have been developed. Some of these techniques are based on the removal of the manufacture from the machine used for its production and on its transfer to a station for further working, separate from the production machine, so as to close the toe of the hosiery item in the station for further working while the machine is used for the production of another sock. These techniques have the advantage, with respect to other techniques based on closing the toe of the hosiery item directly on the machine used for its production, of not excessively impairing the productivity of the machine.

The transfer of the hosiery item, or more generally of the tubular manufacture, from the machine used for its production to the station in which the closing of an axial end of the manufacture, or more generally further work on the manufacture, is to be performed is generally performed by means of a removal device which, by means of removal members, picks up individually the loops of knitting of the manufacture from the needles of the machine and holds them during the transfer of the manufacture.

In some techniques for closing the toe of hosiery items, the removal device is used also to support the manufacture during the execution of the further work, while in other techniques the removal device is used only to transfer the manufacture since once it has reached the station in which the further work is to be performed it releases, usually again individually, the loops of knitting, previously removed from the needles, to another device that has the function of supporting the manufacture during the execution of the further work, such as for example a handling device. Said handling device makes the loops belonging to one half of the course of knitting received by the removal device face the loops belonging to the other half of the same course of knitting and support the two half-courses in a mutually facing position during the intervention of a sewing or looping head which joins the mutually facing pairs of loops of knitting.

In removal devices of the known type used in order to simply transfer the manufacture from the machine that produces it to a handling device, the coupling between the removal members and the needles, in order to perform the transition of the loops of knitting from the needles to the removal members, occurs usually by means of the insertion of the needle head in a seat formed in the end of the removal member. For this reason, the removal device usually has a circular annular removal body, which is designed to face coaxially the end of the needle cylinder from which the needle heads protrude and which supports a plurality of removal members oriented parallel to the axis of the removal body.

A removal device of this type is described, for example, in European Patent EP0942086 B1.

The aim of the present invention is to provide a removal device for removing a tubular knitted manufacture from a circular knitting machine for hosiery or the like that has an increased level of safety with regard to the accidental disengagement of loops of knitting from the removal members.

Within this aim, an object of the invention is to provide a device that has in any case a high structural simplicity and ensures excellent precision in the coupling of the removal members with the needles of the machine used to produce the manufacture.

Another object of the invention is to provide a removal device that can have a particularly low radial volume.

Another object of the invention is to provide a removal device that can also obviate radial position errors of the needles of the machine used for producing the manufacture.

Yet another object of the invention is to provide a device that ensures high reliability in use.

Another object of the present invention is to provide a removal device for removing a tubular knitted manufacture from a circular knitting machine for hosiery or the like that is capable of improving the background art in one or more of the aspects mentioned above.

Another object of the invention is to provide a removal device for removing a tubular knitted manufacture from a circular knitting machine for hosiery or the like that is highly reliable, relatively easy to provide and at competitive costs.

This aim and these and other objects which will become more apparent hereinafter are achieved by a removal device for removing a tubular knitted manufacture from a circular knitting machine for hosiery or the like, according to claim 1, optionally provided with one or more of the characteristics of the dependent claims.

Further characteristics and advantages of the invention will become more apparent from the description of some preferred but not exclusive embodiments of the removal device for removing a tubular knitted manufacture from a circular knitting machine for hosiery or the like according to the invention, illustrated by way of non-limiting example in the accompanying drawings, wherein.

Figure 1:
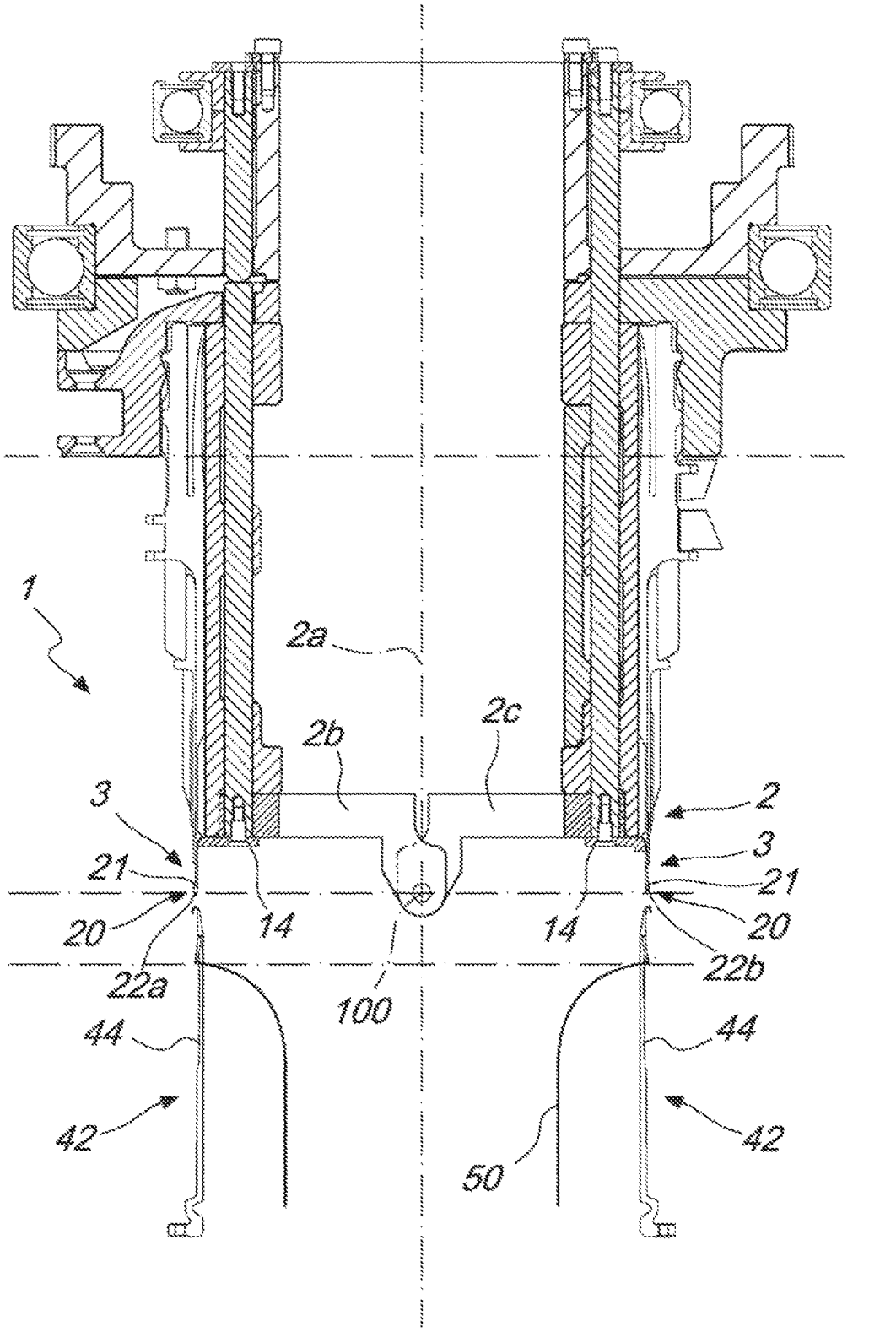
FIG. 1 is a diametrical sectional view of the removal device disengaged from the needle cylinder.
Figure 2:
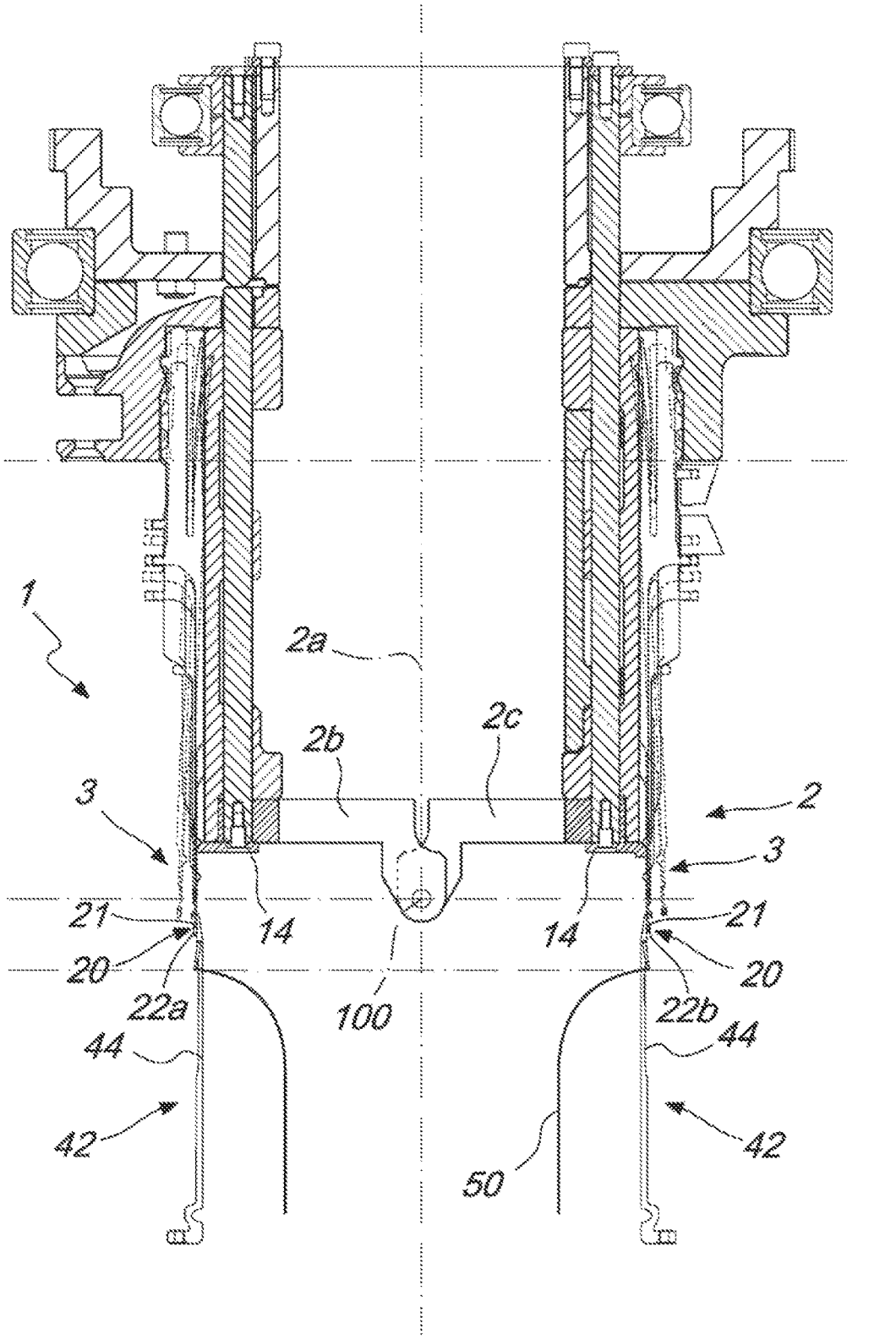
FIG. 2 is a diametrical sectional view of the removal device in the step of engagement with the needles of the needle cylinder.

With reference to the figures, the removal device according to the invention, generally designated by the reference numeral 1, is adapted to remove a tubular knitted manufacture from a circular knitting machine for hosiery or the like.

The removal device 1 comprises an annular removal body 2 which supports a plurality of removal members 3 arranged around the axis 2*a* of the removal body 2.

The removal body 2 is arrangeable coaxially around the needle cylinder 42 of a circular knitting machine for hosiery or the like with each one of the removal members 3 arranged so as to correspond to a respective needle 44 of the machine.

The removal members 3 are supported by first and second annular portions (2*b*, 2*c*).

The first and second annular portions (2*b*, 2*c*) can move by rotation with respect to each other about an oscillation axis (100) that is substantially perpendicular to the axis (2*a*) of the removal device in order to pass between a removal condition, in which they are arranged so as to form a circumference that is coaxial with the axis (2*a*) of the removal device, and a sewing condition, in which the annular portions (2*b*, 2*c*) are arranged so as to face each other.

The first and second annular portions 2*b*, 2*c* support a plurality of removal members 3.

The removal members 3 form a respective removal head 20, which can move on command along a removal trajectory which has a component that is parallel to the axis 2*a* of the removal body 2 and a component that is radial with respect to said axis 2*a*.

In particular, the removal trajectory has at least one radial component away from said axis 2*a*.

The removal head 20 comprises, moreover, a wider portion 21 designed to penetrate within the respective loop of knitting.

The removal heads 20 are, moreover, adapted to move, as a consequence of penetration in the respective loop of knitting, below the knockover plane.

Furthermore, it is possible to ensure that each annular portion 2*b*, 2*c* is associated with at least one stitch pressing device 14, which is movable with respect to the removal heads 20 in order to arrange the removed loops of knitting mutually adjacent during the sewing step.

Advantageously, the removal body 2 can rotate on command about the axis 2*a* at the same angular velocity as the needle cylinder 42 during the steps of engagement of each removal member 3 with the corresponding needle 44.

Preferably, the removal members 3 comprise a locking tab 15 which can move on command between a position that is spaced from the removal head 20 and a position that is closer to the removal head 20.

In particular, in the position that is closer to the removal head, the locking tab 15 is designed to keep the loop of knitting removed by the removal member 3 stably locked.

Conveniently, the removal member 3 extends along a main direction of longitudinal extension.

Said main direction of longitudinal extension is arranged substantially parallel to the axis 2*a* when the removal member 3 is disengaged from the needle cylinder 42.

Advantageously, the locking tab 15 is movable, with respect to the removal head 20, along a direction that is substantially parallel to the main direction of extension of the respective removal member 3.

Figure 11:
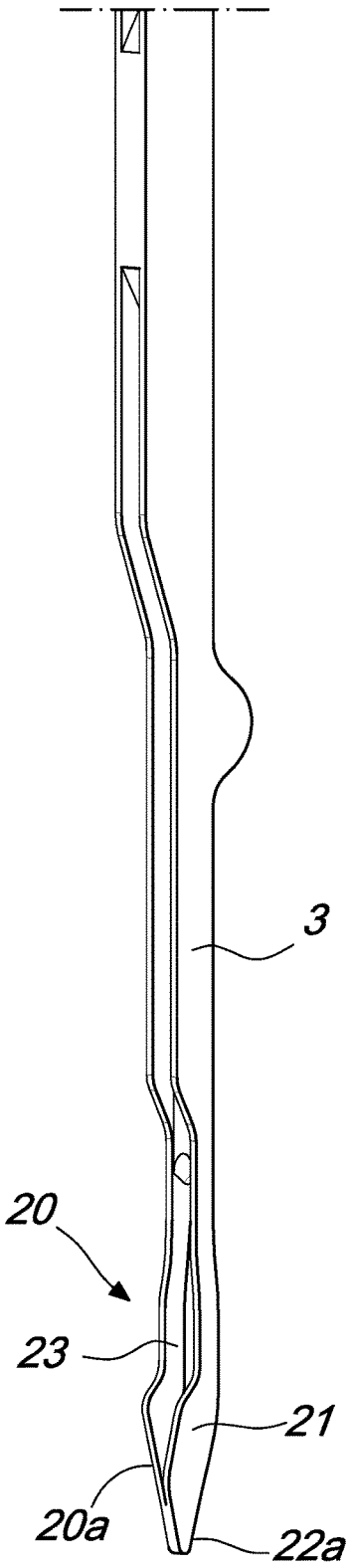
FIGS. 11 to 13 are perspective views of the various elements that constitute the removal member.
Figure 12:
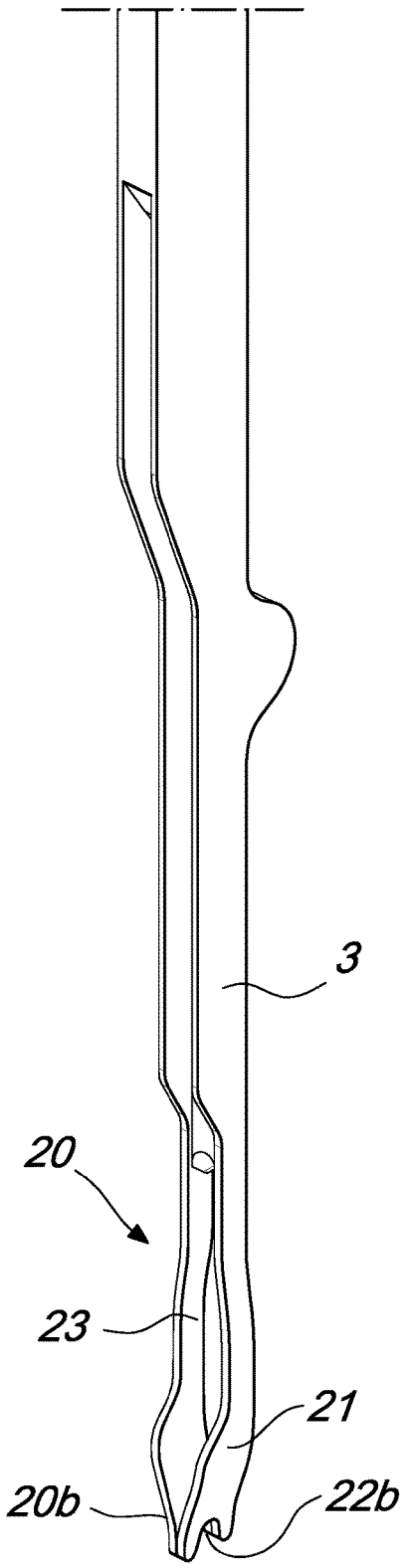
Figure 13:
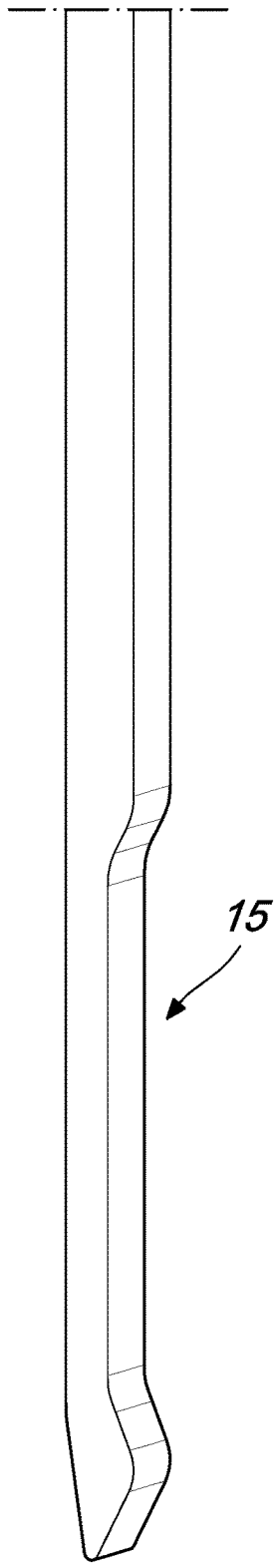
Figure 14:
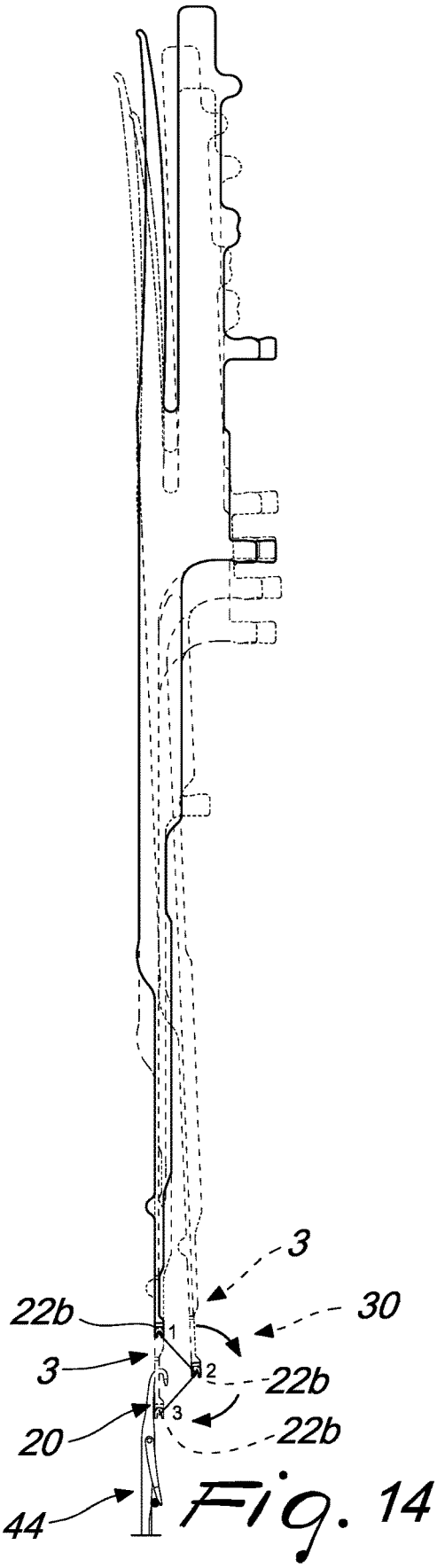
FIG. 14 is an enlarged-scale view of the sequence of engagement of the removal member with the respective needle in order to remove the loop of knitting.
Figure 15:
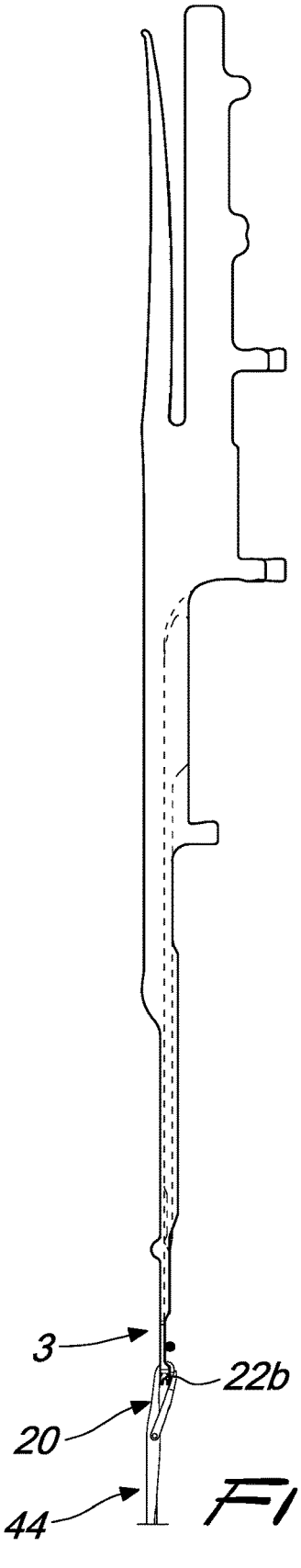
FIG. 15 is an enlarged-scale view of the sequence for the transfer of the loop of knitting.
Figure 16:
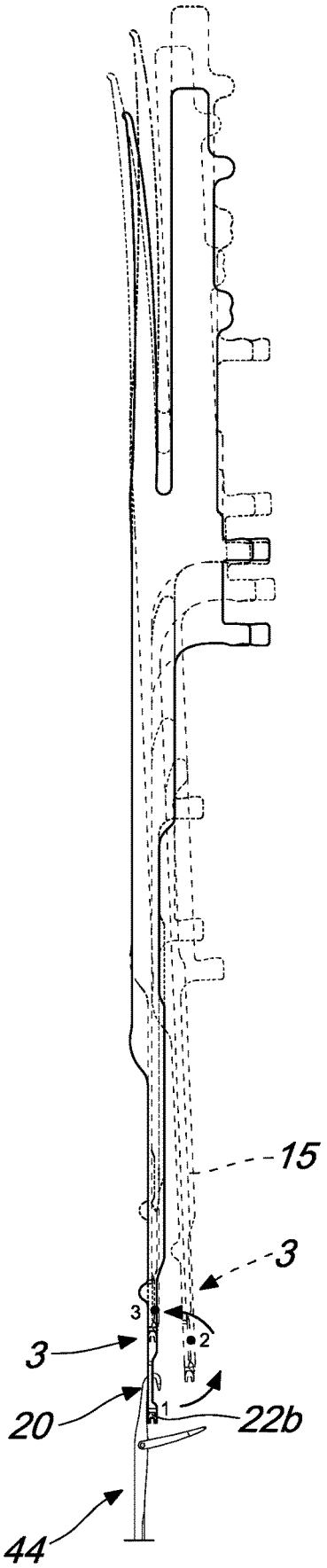
FIG. 16 is an enlarged-scale view of the sequence of disengagement of the removal member from the respective needle once the loop of knitting has been removed.

According to a preferred embodiment, the removal heads 20 comprise first removal heads 20*a*, shown in FIG. 11, and second removal heads 20*b*, shown in FIG. 12.

The first removal heads 20*a* and the second removal heads 20*b* are designed to be arranged, when the removal member is moved to the sewing condition, in respective abutment.

The first removal heads 20*a* comprise a male terminal 22*a* while the second removal heads 20*b* comprise a female terminal 22*b*.

When the first removal heads 20*a* abut against the respective second removal heads 20*b*, the male terminal 22*a* of the first removal heads 20*a* engages inside a corresponding female terminal 22*b* of a corresponding second removal head 20*b*.

According to one practical embodiment, the first annular portion 2*b* supports removal members 3 provided with first removal heads 20*a*, while the second annular portion 2*c* supports removal members 3 provided with second removal heads 20*b*.

The use of first removal heads 20*a* with a male terminal 22*a* associated with the removal members 3 of the first annular portion 2*b* and of second removal heads 20*b* with a female terminal 22*b* associated with the removal members 3 of the second annular portion 2*c* allows to move the loop initially associated with the female terminal 22*b* onto the corresponding male terminal 22*a* without any interference during this transition.

Conveniently, the removal trajectory provides, during the step of approach of the removal heads 20 to the respective needle 44, a portion of trajectory away from the axis 2*a* in order to move the removal head 20 externally with respect to the needle cylinder 42, and subsequently a portion of approach to the axis 2*a* in order to move the removal head 20 at the respective needle 44.

Conveniently, the removal head 20 comprises a longitudinal recess 23.

The removal device 1, moreover, has selective actuation means for the movement of the removal members 3.

Said selective actuation means can, for example, comprise cam devices designed to move the removal members 3 and the various components that constitute them, such as the removal head 20 and the locking tab 15.

The operation of the removal device 1, according to the invention, is as follows.

The removal body 2 (FIG. 1) is arranged facing and in axial alignment with the needle cylinder 42 with the annular portions (2*b*, 2*c*) in the removal condition.

The removal body 2 is rotated about its own axis 2*a* at the same rotation rate as the needle cylinder 42.

Once the needle cylinder 42 has finished the forming of the tubular manufacture 50, adapted cam devices selectively actuate the lowering of the removal members 3 toward the respective needle 44.

Figure 3:
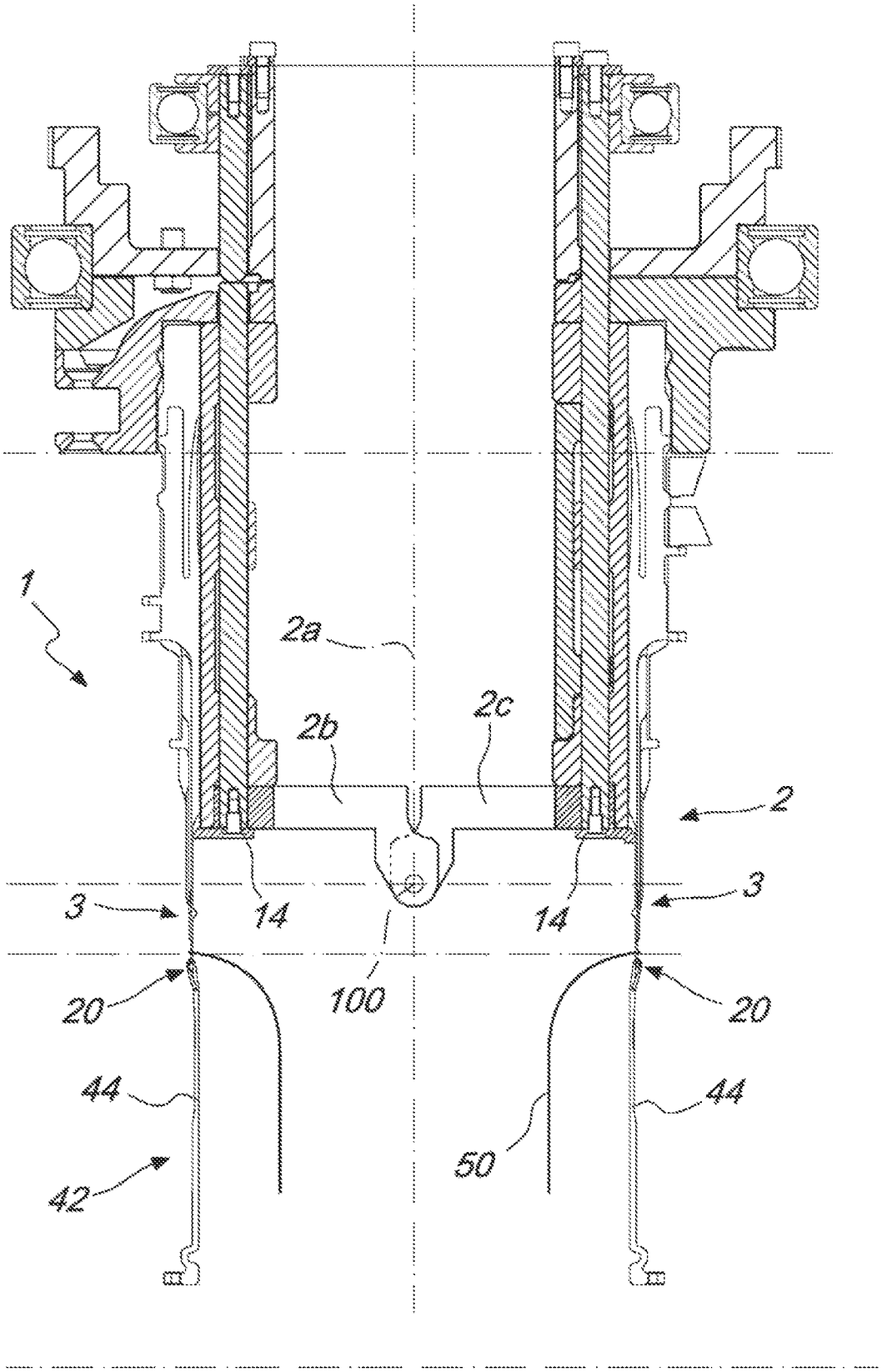
FIGS. 3 to 5 are diametrical sectional views of the removal device in the step of transferring the loops of knitting to the removal device.

The respective removal heads 20 (FIG. 3), by lowering themselves, also move toward the outside of the needle cylinder 42 in order to move beyond the respective needle 44.

Figure 4:
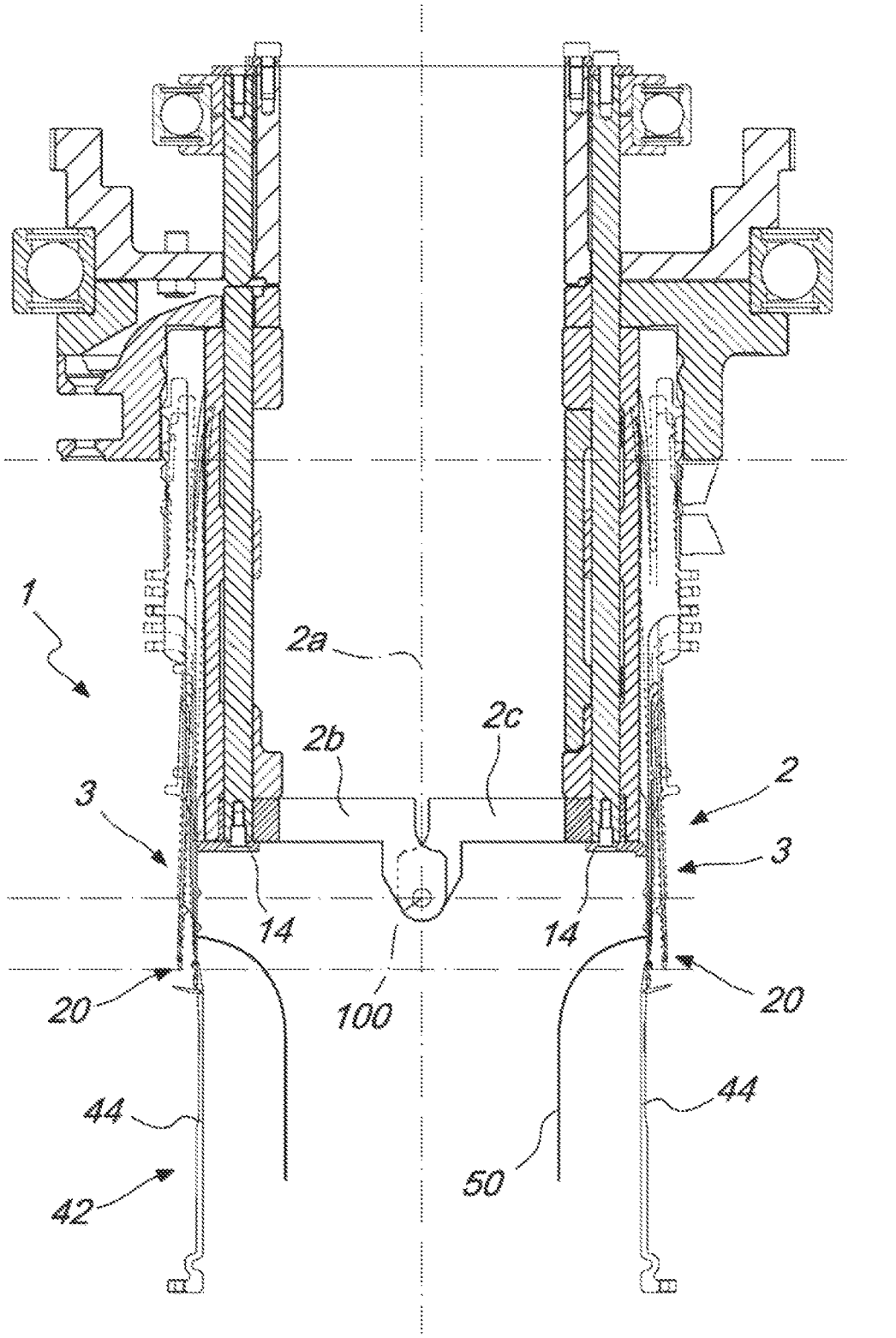
Figure 5:
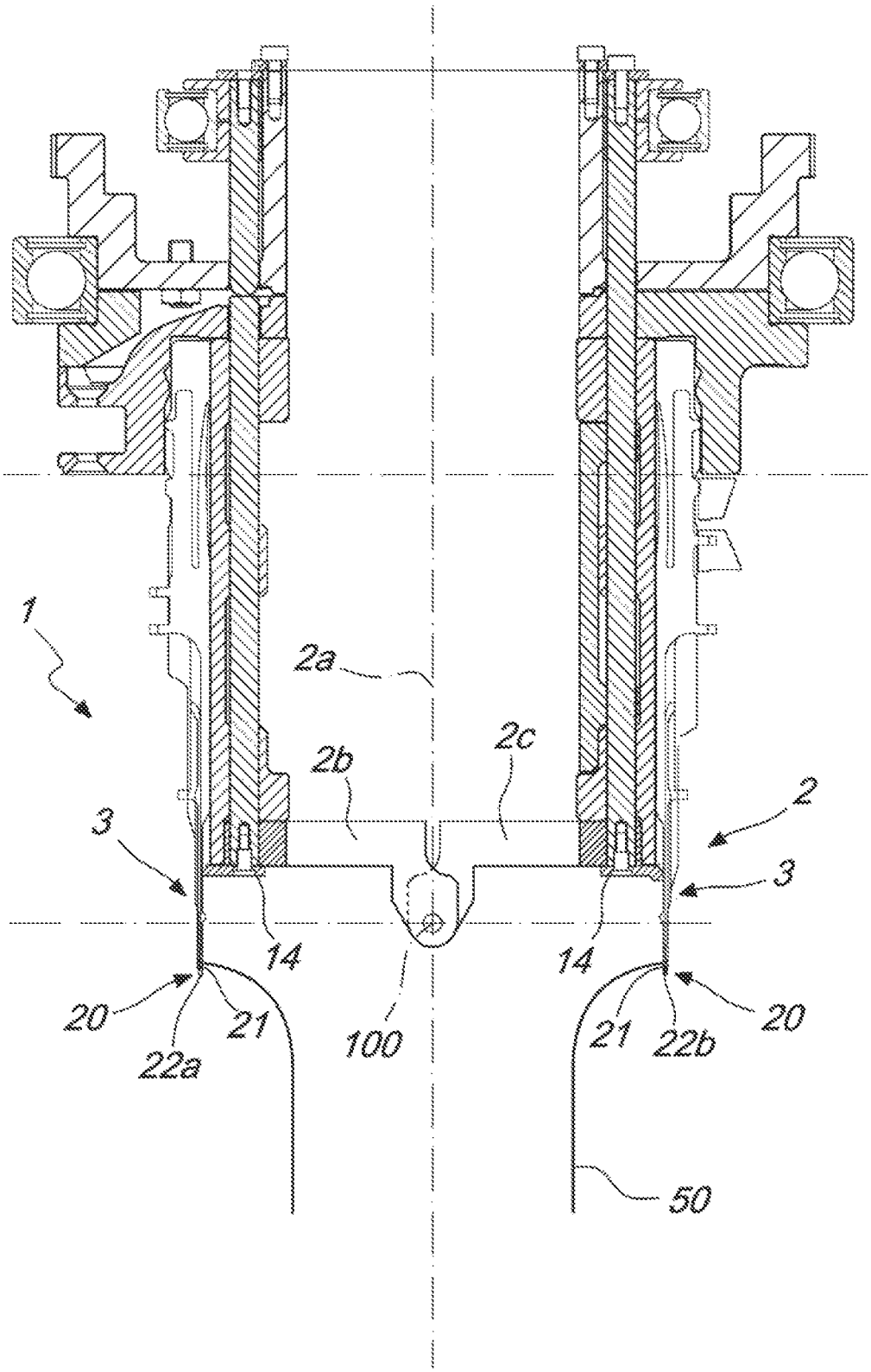
Figure 6:
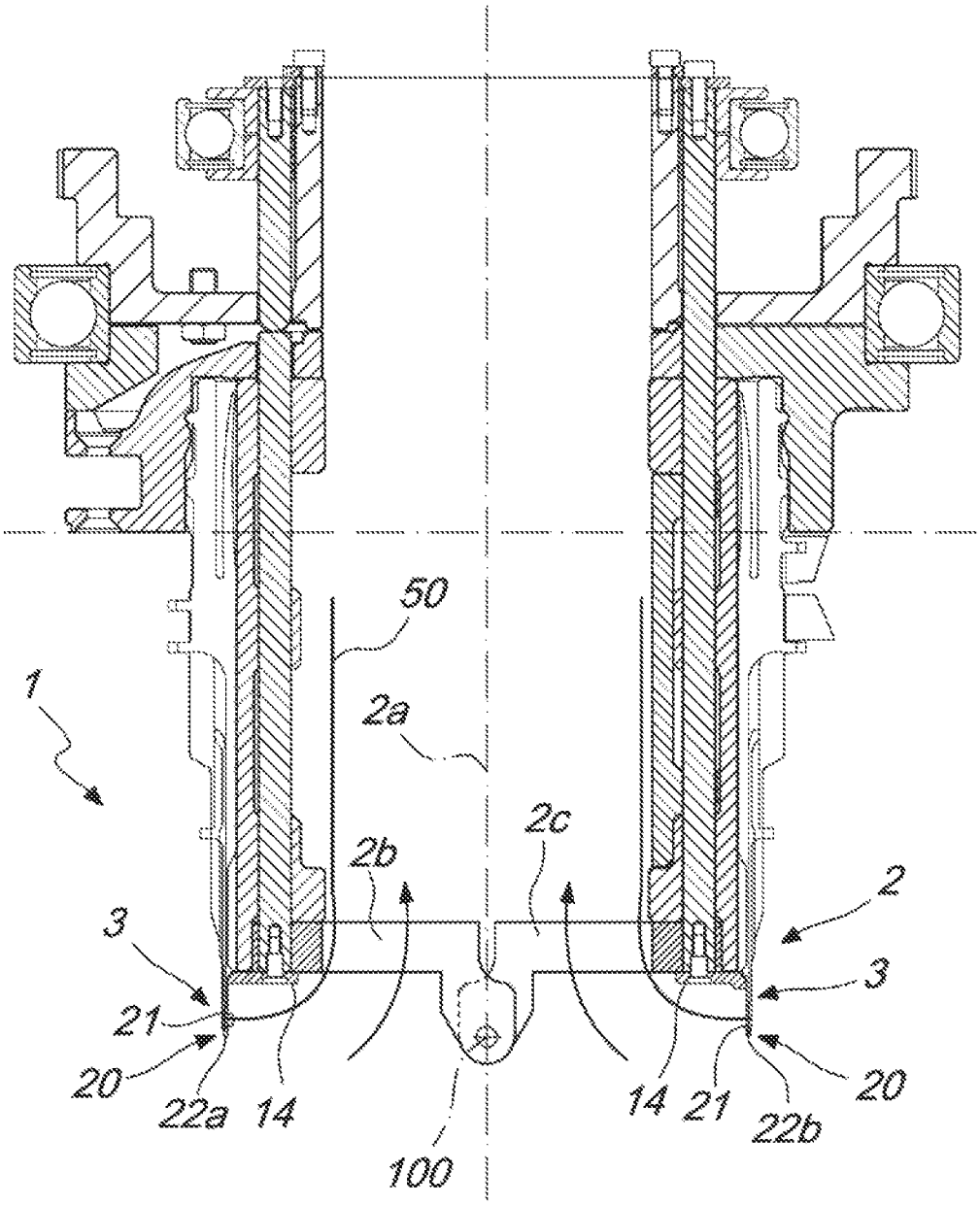
FIG. 6 is a diametrical sectional view of the removal device with the loops of knitting completely transferred.
Figure 7:
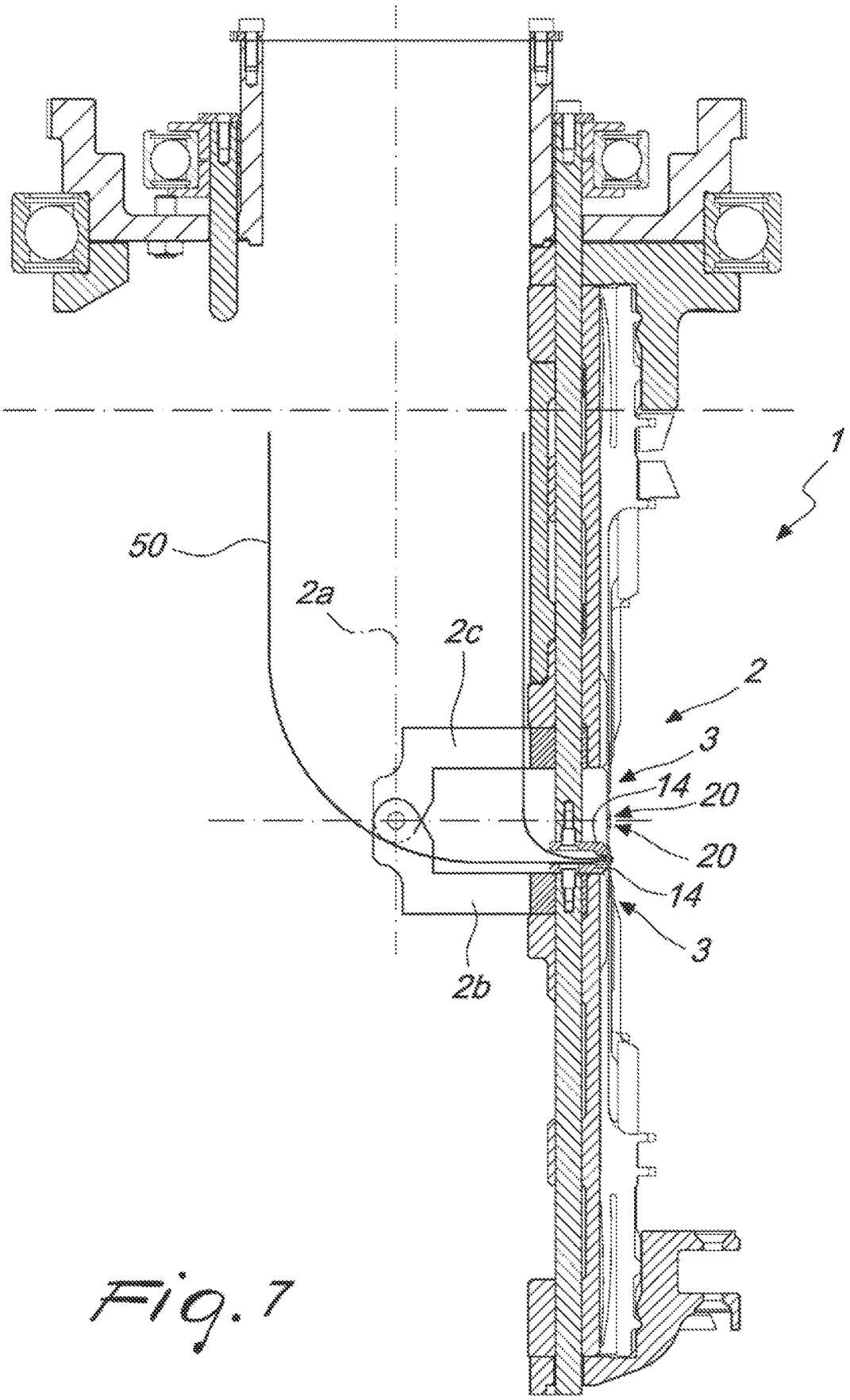
FIG. 7 is a diametrical sectional view of the removal device with the two annular portions in the sewing condition.
Figure 8:
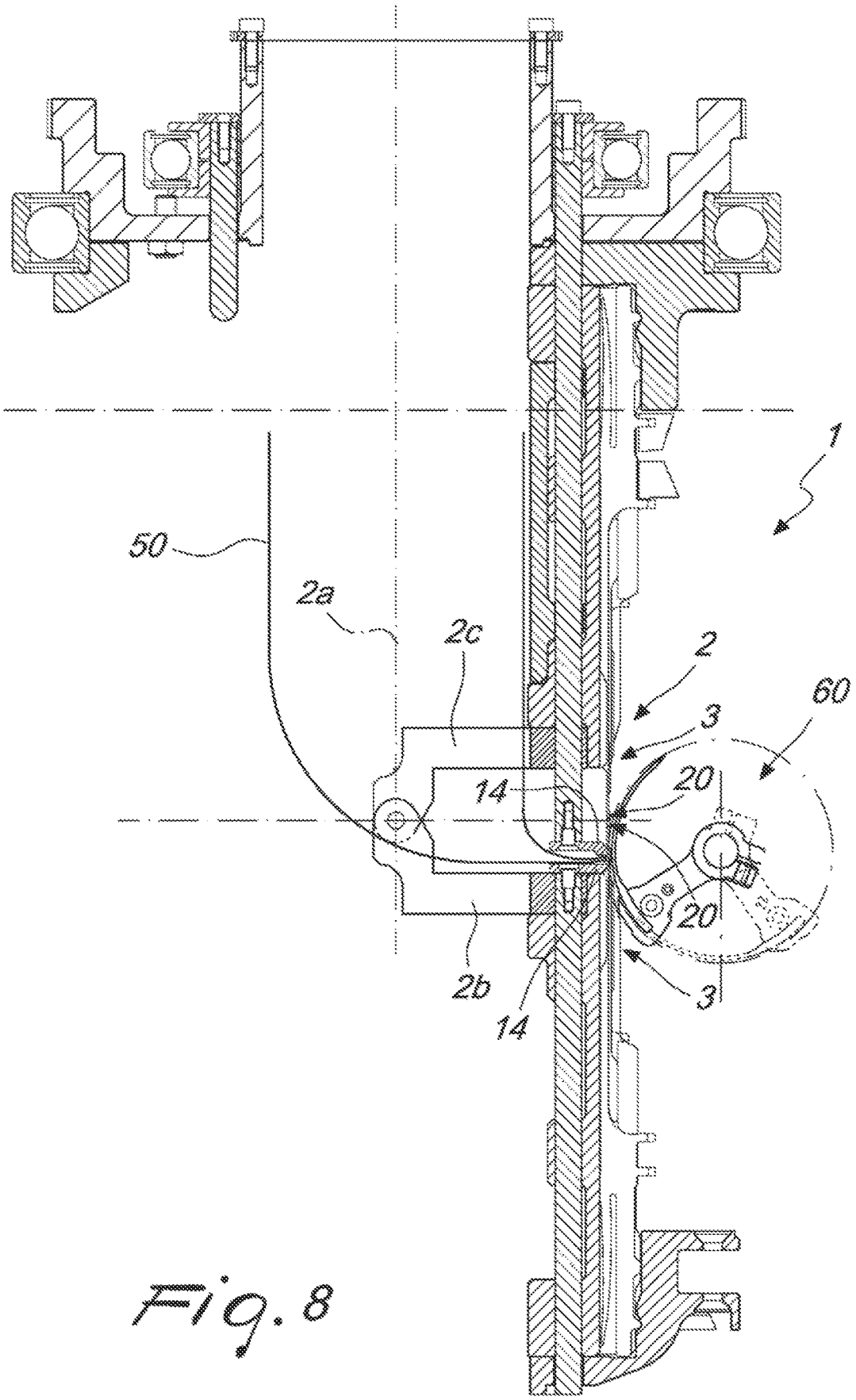
FIG. 8 is a diametrical sectional view of the removal device with the two annular portions in the sewing condition during the sewing step.
Figure 9:
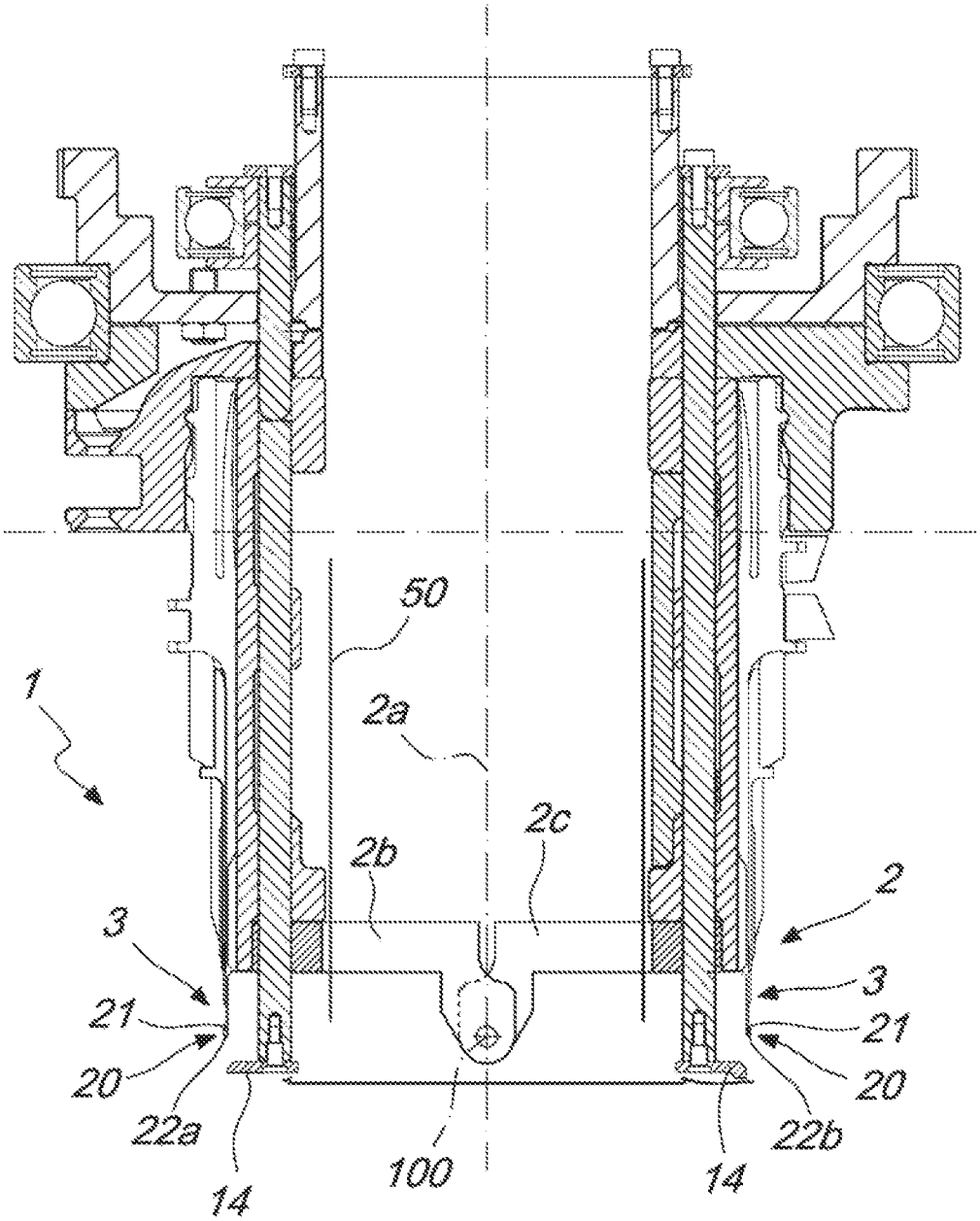
FIGS. 9 and 10 are diametrical sectional views of the removal device with the two annular portions in the removal condition at the end of the sewing step.
Figure 10:
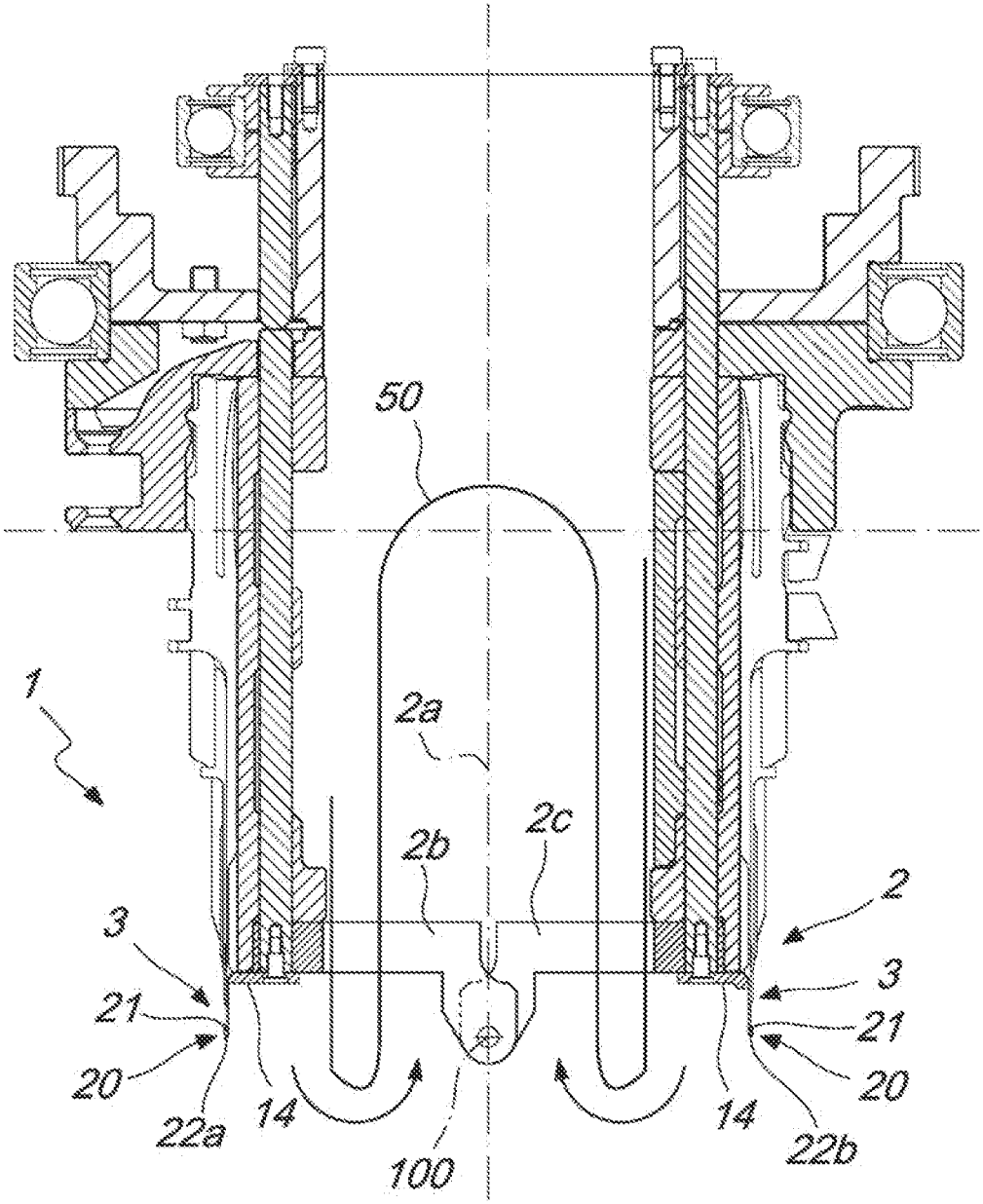

By continuing their lowering (FIG. 4), the removal heads arrange themselves at the needle 44 until the wider portion 21 of the removal head 20 penetrates inside the loop of knitting.

In this movement, the removal heads 20 move, as a consequence of the penetration in the respective loop of knitting, below the knockover plane.

Optionally, the locking tab 15 is moved closer to the removal head 20 in order to stably lock the loop of knitting transferred onto the removal member 3.

At this point (FIG. 4), the removal member 3 is lifted (or the needle 44 is lowered) in order to move away from the needle cylinder 42 and the tubular manufacture is inverted.

The annular portions (2*b*, 2*c*) are caused to perform a relative rotation about the oscillation axis 100 in order to move from the removal condition to the sewing condition.

The sewing unit then sews the loops of knitting.

In practice it has been found that the invention achieves the intended aim and objects, providing a removal device that is extremely practical and effective.

The invention thus conceived is susceptible of numerous modifications and variations, all of which are within the scope of the inventive concept; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102019000023577 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A removal device for removing a tubular knitted manufacture from a circular knitting machine for hosiery or the like, comprising an annular removal body which supports a plurality of removal members arranged around an axis of said removal body, said removal body being arrangeable coaxially around a needle cylinder of a circular knitting machine for hosiery or the like with each one of said removal members arranged so as to correspond to a respective needle of the machine, said removal body being configured to rotate on command about the axis of the removal body at a same angular velocity as said needle cylinder during steps of engagement of each removal member with the corresponding needle, wherein said removal members are supported by first and second annular portions which can move by rotation with respect to each other about an oscillation axis that is substantially perpendicular to the axis of the removal body in order to pass between a removal condition, in which said first and second annular portions are arranged so as to form a circumference that is coaxial with the axis of the removal device, and a sewing condition, in which said first and second annular portions are arranged so as to face each other, each of said removal members comprising a respective removal head which can move on command along a removal trajectory which has a first position that is substantially parallel to the axis of the removal body and at least one second position that is spaced radially outward from the axis of the removal body, said removal head comprising a wider portion designed to penetrate within a respective loop of knitting, wherein said removal heads are adapted to move, as a consequence of the penetration of the respective loop of knitting, below a knockover plane, and wherein said removal head comprises a longitudinal recess extending linearly within the removal member through the wider portion of the removal head.

2. The removal device according to claim 1, wherein said removal members comprise a locking tab which can move on command between a position that is spaced from said removal head and a position that is closer to said removal head in which said locking tab is designed to keep said loop of knitting stably locked.

3. The removal device according to claim 1, wherein said removal heads comprise first removal heads and second removal heads designed to be arranged, in said sewing condition, in respective abutment, said first removal heads comprising a male terminal and said second removal heads comprising a female terminal inside which a corresponding male terminal of a corresponding first removal head can engage, said first annular portion supporting removal members provided with said first removal heads and said second annular portion supporting removal members provided with said second removal heads.

4. The removal device according to claim 1, further comprising actuation means for the movement of said removal members wherein the actuation means comprise cam devices designed to move the removal members.

* * * * *